United States Patent [19]

Graudejus et al.

[11] Patent Number: 5,056,371

[45] Date of Patent: Oct. 15, 1991

[54] METHOD AND APPARATUS FOR DETERMINING THE FILLING CAPACITY OF TOBACCO

[75] Inventors: Wolfgang Graudejus, Haselau; Martin Rattemeyer, Hamburg, both of Fed. Rep. of Germany

[73] Assignee: H. F. & Ph. F. Reemtsma GmbH & Co., Hamburg, Fed. Rep. of Germany

[21] Appl. No.: 571,975

[22] Filed: Aug. 24, 1990

[30] Foreign Application Priority Data

Sep. 2, 1989 [DE] Fed. Rep. of Germany ..... 3929154

[51] Int. Cl.[5] ..... G01N 11/00

[52] U.S. Cl. ..... 73/823

[58] Field of Search ..... 73/823, 818, 825; 364/476

[56] References Cited

U.S. PATENT DOCUMENTS 3,115,772 12/1963 O'Keeffe et al. ..... 73/94
3,641,734 2/1972 Fishburne ..... 53/124

FOREIGN PATENT DOCUMENTS 1432587 11/1968 Fed. Rep. of Germany .
8223662.3 1/1984 Fed. Rep. of Germany .
3432839 3/1986 Fed. Rep. of Germany .
661292 5/1979 U.S.S.R. ..... 73/818

OTHER PUBLICATIONS

"Untersuchungen mit einem . . . Fullfahighheit . . . " von Lorenz et al., Beitraege zur Tabakforschung, vol. 4, Issue 7, (1968).

*Primary Examiner*—Jerry W. Myracle
*Attorney, Agent, or Firm*—Nixon & Vanderhye

[57] ABSTRACT

To determine the filling capacity of tobacco, a predetermined quantity of tobacco is filled into a volume of known cross-section forming part of a press, closed on one side by a movable plunger, and the length of the tobacco column and the force acting on the tobacco during compression of the tobacco by the plunger are measured as a function of time. The output data are processed by at least one computer while the tobacco is being packed into packaging containers by means of the press. The length of the tobacco column is determined from the measured distance covered by the movable plunger of the press which compresses the tobacco and in doing so moves it into the packaging container. The force acting on the tobacco is measured from the pressure required to drive the plunger, or from the supporting force required to hold the packaging container, or from the force occurring at the plunger or its drive elements. Additional parameters such as tobacco temeprature and moisture content governing the value of the filling capacity are determined in independent measurements and fed into the computer. The method is preferably applied to leaf tobacco.

16 Claims, 7 Drawing Sheets

*Fig. 4a*
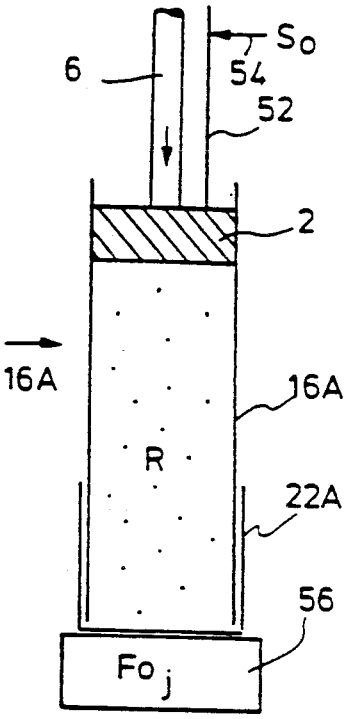
*Fig. 4b*
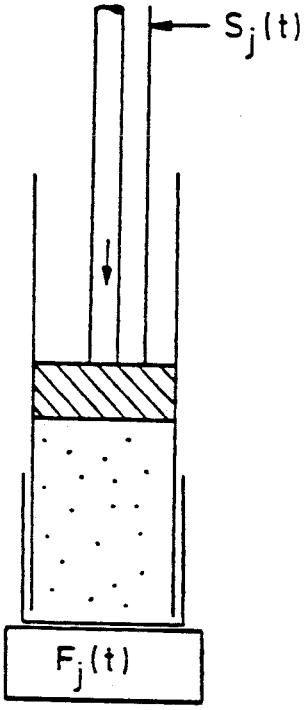
*Fig. 4c*
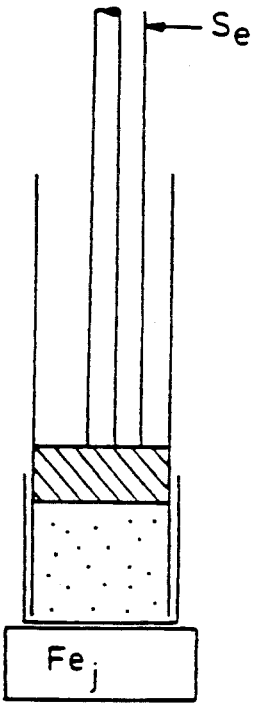
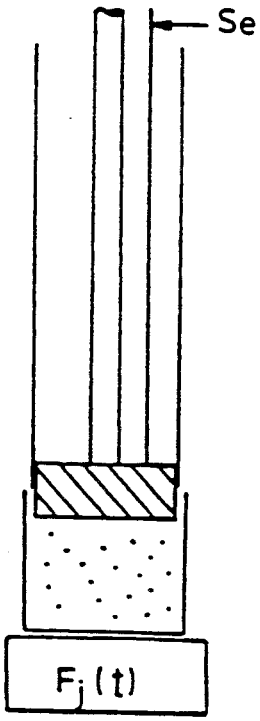
*Fig. 4d*
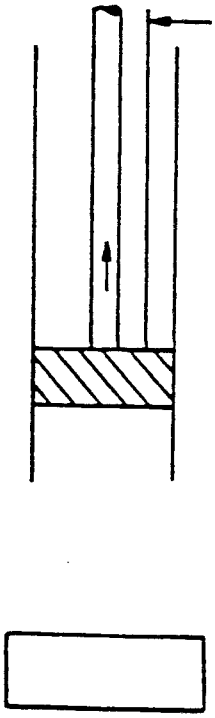
*Fig. 4e*
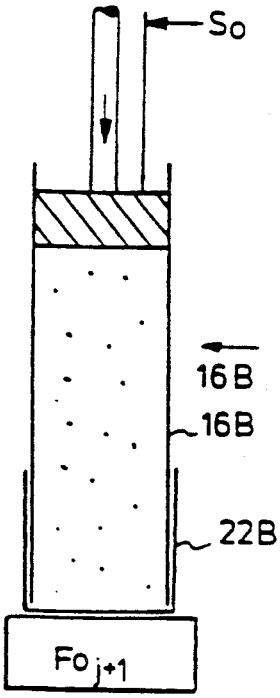
*Fig. 4f*

*Fig. 7a*

| OPERATION PHASES OF THE PRESS | | | MEASURED VALUES | | CONTROL SIGNAL |
|---|---|---|---|---|---|
| 201 | 202 | 203 | 204 | 205 | 206 |
| FILLING 1st HOPPER 16A | | | Tj(t) WGj(t) | | 101 |
| MOVING 1st HOPPER 16a | FILLING 2nd HOPPER 16B | | | Foj , Poj | 102 |
| | | LOWER PLUNGER 2 | | | 103 104 |
| RAISING 1st HOPPER 16A | | | | Fj(t), Pj(t) Sj(t) | 105 |
| | | REST TIME FOR PLUNGER 2 IN LOWEST POSITION Sj(t) = So | Tj+1(t) WGj+1(t) | Fj(t), Pj(t) | 106 107 |
| | | | | | 108 |
| RETURNING 1st HOPPER 16A | | TRANSPORT OF BOX 22A | | | 109 |
| | | | | mj | 101 |
| FILLING 1st HOPPER 16A | MOVING 2nd HOPPER 16B | | Tj+2(t) WGj+2(t) | Foj+1, Poj+1 | 102 |
| | | LOWERING PLUNGER 2 | | | 103 104 |

*Fig. 7b*

| CONTROL SIGNAL 206 | PROCESS-CONTROL COMPUTER 207 | MAIN COMPUTER 208 |
|---|---|---|
| 101 | (RECEIPT OF MASTER DATA) | (ENTRY OF MASTER DATA) |
| 102 | MEASUREMENT OF INITIAL VALUES | CONTINUOUS MEASUREMENT AND AVERAGING OF TEMPERATURE (T) AND MOISTURE (WG) OF THE TOBACCO<br>CONTINUOUS REQUEST AS TO WHETHER THERE ARE DATA FOR RECEIVING FROM THE PROCESS-CONTROL COMPUTER |
| 103 | | |
| 104 | START OF COMPR. MEASMT. FROM So | |
| 105 | MEASURE COMPRESSION CURVE, SUBSTRACT INITIAL VALUES, STORE VALUES | |
| 106<br>107 | (MARK DISTURBED MEASUREMENT VALUES FOR RELAXATION CURVE) | |
| 108 | MEASURE RELAXATION CURVE, SUBSTRACT INITIAL VALUES, STORE VALUES | |
| 109 | | |
| 101 | RECORD BOX WEIGHT | |
| | SEND DATA TO MAIN COMPUTER | STORE COMPRESSION CURVE, RELAXATION CURVE, WEIGHT |
| 102 | MEASURE INITIAL VALUES | STORE THE VALUES FOR T AND WG ASSIGNED TO BOX NO. J |
| 103 | | CONTINUOUS MEASUREMENT AND AVERAGING OF T AND WG |
| 104 | START OF COMPRESSION MEASUREMENT FROM So | |

*Fig. 7c*

ABBREVIATIONS

T TEMPERATURE OF THE TOBACCO

WG WATER CONTENT (MOISTURE) OF THE TOBACCO t TIME j INDEX NUMBER OF MEASUREMENT CYCLE (CARDBOARD BOX)

F FORCE ACTING ON THE TOBACCO

P PRESSURE DRIVING THE PLUNGER

Fo FORCE BEFORE COMPRESSION MEASUREMENT (INITIAL VALUE)

Po PRESSURE BEFORE COMPRESSION MEASUREMENT (INITIAL VALUE)

So INITIAL VALUE FOR DISTANCE MEASUREMENT m TOBACCO MASS PER CARDBOARD BOX

SIGNALS

101 NOMINAL WEIGHT REACHED

102 POSITION CHECK FOR HOPPER (HOPPER SENSOR)

103 START PLUNGER MOVEMENT

104 INITIAL VALUE FOR DISTANCE MEASUREMENT REACHED (So)

105 LOWEST POSITION OF PLUNGER REACHED (Se)

106 RAISE HOPPER

107 HOPPER RAISED

108 END OF REST TIME OF PLUNGER

109 CARDBOARD BOX HAS REACHED BALANCE

METHOD AND APPARATUS FOR DETERMINING THE FILLING CAPACITY OF TOBACCO

BACKGROUND AND SUMMARY OF THE INVENTION

The invention relates to a method for determining the filling capacity of tobacco, in which method a predetermined quantity of tobacco is filled into a volume of known cross-section, closed on one side by a movable plunger, and in which method the respective length of the tobacco column and the respective force acting on the tobacco via the plunger are measured as a function of time.

The filling capacity corresponds to the visco-elasticity and compressibility of tobacco. It can be defined as the volume which a given mass of tobacco occupies after being subjected to a certain pressure for a certain time. The filling capacity of tobacco is greatly dependent upon its temperature and moisture. As tobacco exhibits a marked relaxation behavior, a reproducible measurement of the filling capacity of tobacco is only possible using a process which is also precisely defined as regards time. The filling capacity depends on the type of tobacco and is an important characterizing variable for the evaluation of the tobacco quality.

A method and an apparatus for the determination of the filling capacity of tobacco are known from the article "Untersuchungen mit einem verbesserten Densimeter zum Pruefen der Fuellfaehigkeit von Schnittabak und der Haerte von Cigaretten", by H. W. Lorenz and F. Seehofer, Beitraege zur Tabakforschung, Volume 4, issue 7 (1968). To measure the filling capacity, about 20 g of tobacco are poured loosely into a cylindrical container ca. 60 mm. in diameter. If this container is placed in the known apparatus, a pressure plate on which a weight has been placed, sinks from above onto the tobacco. The position of the pressure plate and consequently the height of the tobacco column is transmitted to a dial gauge or another display device. After a preselected time, which is on the order of one minute, has passed, a motor automatically lifts away the pressure plate including the weight from the compressed tobacco and the final height of the tobacco column is displayed as a measure of the filling capacity.

Owing to the small size of the tobacco container, this method is limited to determining the filling capacity of cut tobacco when the known apparatus is used. The accurate measurement of a curve which represents the pattern of the final height of the tobacco column as a function of time is tedious because an individual measurement must be carried out for each time value. A further disadvantage is that the method only allows the filling capacity of tobacco to be determined by means of random samples with small amounts of tobacco. The temperature and the moisture, or the water-content, of the tobacco, which have a considerable effect on the filling capacity, cannot be measured directly in the known apparatus. The moisture, for example, must be determined separately using a drying chamber. The tobacco moisture can change during the lengthy filling capacity measurements or when the associated moisture determination is not carried out immediately before or after the measurement, which leads to a distortion of the results for the filling capacity.

The object of the invention is to provide a method of the type mentioned above for the determination of the filling capacity of tobacco, in which method the measurement of the filling capacity takes place completely so that it is not restricted to random samples and so that a certain tobacco quantity can in each case be allocated a filling capacity value. The filling capacity is to be measured with a high degree of accuracy in this method, taking into account the determining parameters. The method is to run automatically, and interruptions or delays to the normal procedure in the handling of tobacco are to be avoided. Furthermore, the method is to be inexpensive and able to be implemented without using expensive machinery.

To achieve this aim, the necessary measurement variables are acquired and processed automatically by at least one computer while the tobacco is being packed into packaging containers by means of a press, or during additional pressing by a press after packing, the length of the tobacco column being determined from the measured distance covered by a movable plunger of the press which compresses the tobacco and in doing so moves it into said packaging container, or which plunger performs the additional pressing of the tobacco, and the force acting on the tobacco being determined from the measured pressure required to drive said plunger, or from the measured supporting force required to hold said packaging container, or from the measured force occurring at said plunger or its drive elements, and additional parameters governing the value of the filling capacity are determined in independent measurements and fed into said computer which calculates filling capacity values therefrom.

In this way the quantity of tobacco packed into any given packaging container is assigned a reliable filling capacity value determined by means of a well defined, reproducible measuring process. This makes possible an uninterrupted testing of the quality of the tobacco.

A further object of the invention is to provide a method of the type mentioned initially for the determination of the filling capacity of tobacco which can be applied to leaf tobacco and which meets the other requirements mentioned above.

To achieve this aim the above described method is applied to leaf tobacco.

In this way the quantity of leaf tobacco packed into any given packaging container is assigned a reliable filling capacity value determined by means of a well defined, reproducible measuring method. This makes possible an uninterrupted testing of the quality of the leaf tobacco. Furthermore, the filling capacity value for the leaf tobacco can be correlated with the value for the filling capacity of the cut tobacco produced later from the leaf tobacco, so that conclusions can be drawn at this early stage about the expected quality of the cut tobacco, which hitherto was not possible and constitutes a great advantage for industrial production.

A further object of the invention is to define the method for the determination of the filling capacity of tobacco that informative data can be obtained for the filling capacity during clearly specified measurement processes.

This is achieved in that a compression curve is recorded in which curve the force acting on the tobacco during the compression is shown as a function of the length of the tobacco column, and in which curve the plunger speed is used as a parameter, and/or in that a relaxation curve is recorded in which curve the force acting on the tobacco is shown as a function of time, after the plunger has reached its end position and the compressed tobacco column has therefore reached its minimum length and while the plunger remains in its end position.

Through this means, curves are made available with data relevant for the filling capacity, from which one or more values can be taken to characterize an assigned filling capacity value.

Another object of the invention is an alternative implementation of the method such that only a few data which are necessary for the determination of a filling capacity value are determined.

This object is achieved by using, during the compression of the tobacco, only a single measurement point or a few measurement points for the force acting on the tobacco and the associated length of the tobacco column, and/or by using only a single measurement point or a few measurement points for the force acting on the tobacco as a function of time, after the plunger has reached its end position and the compressed tobacco column has therefore reached its minimum length and while the plunger remains in its end position.

While this means that not so many measuring points are available as are required for a complete compression curve and/or a complete relaxation curve, it makes the measuring method and the establishment of an assigned filling capacity value particularly simple.

Another object of the invention is to determine all the parameters governing the value of the filling capacity.

To achieve this object, the tobacco temperature and the tobacco moisture are measured before, during or after the compression of the tobacco. The mass of the tobacco filled in, as a parameter governing the measured values of the filling capacity, is determined by weighing.

The force acting on the tobacco is preferably measured simultaneously by several of the alternatives listed above. Using the data obtained, conclusions can, for example, be drawn on the frictional forces occurring during the compression of the tobacco, which must be taken into consideration as machine-specific disturbing factors in the evaluation of the data for the establishment of filling capacity values.

An apparatus for the implementation of the method for the determination of the filling capacity of tobacco consists preferably of a press, known per se, which compresses a predetermined quantity of tobacco by means of a driven, movable plunger, starting from a larger volume, into a packaging container; and on the press are provided a distance-measurement device for measuring the distance covered by the plunger, pressure and/or force-measurement devices for determining the force acting on the tobacco, and interfaces and at least one computer for the automatic acquisition and processing of these measured variables as well as others determined in independent measurements. The press can carry out the actual packaging of the tobacco, but can also be provided for an additional pressing of the tobacco when it is already in its packaging container before the packaging container is sealed.

In a preferred embodiment according to the present invention, there is provided a method for determining the filling capacity of tobacco wherein a predetermined quantity of tobacco is filled into a volume of known cross-section defined by a column, closed on one side by a movable plunger forming part of a tobacco press and on its other side by a support surface, comprising the steps of disposing the tobacco into the column onto the support surface, compressing the tobacco in the volume by relatively moving the plunger and support surface toward one another, determining the length of the tobacco column during relative movement of the plunger and support surface as a function of time by measuring the distance covered by the relative movement of the plunger and the support surface and providing an output signal responsive thereto, determining the force acting on the tobacco as a function of time when the tobacco is compressed in the column and providing an output signal responsive thereto, independently measuring at least one of temperature and moisture content of the tobacco and providing an output signal in response thereto and processing the signals by a computer to determine the filling capacity of the tobacco.

In a further preferred embodiment according to the present invention, there is provided apparatus for determining the filling capacity of tobacco comprising a press for compressing a predetermined quantity of tobacco including a column for receiving the tobacco and a movable plunger for movement within the column, a packaging container for receiving the lower end of the column and the quantity of tobacco in the column when compressed by the plunger, a distance measurement device for measuring the distance moved by the plunger when compressing the tobacco, a measurement device for determining the force acting on the tobacco during compression thereof and providing an output signal in response thereto, means for measuring at least one of the temperature and moisture content of the tobacco and providing an output signal in response thereto and at least one computer for processing the signals for determining the filling capacity.

These and further objects and advantages of the present invention will become more apparent upon reference to the following specification, appended claims and drawings.

BRIEF DESCRIPTION OF THE DRAWING FIGURES

Figure 1:
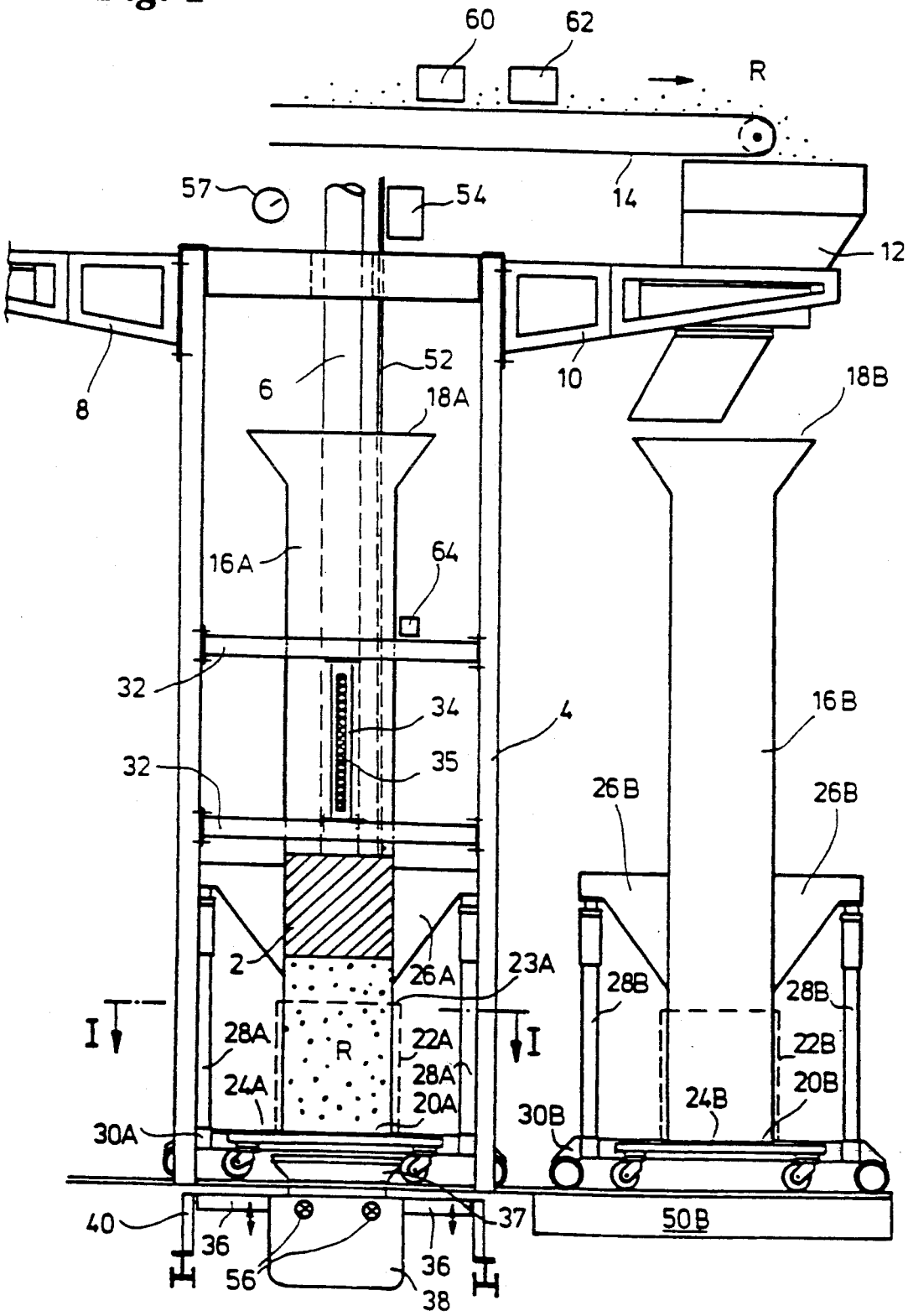
FIG. 1 is a diagrammatic longitudinal section through a press for packaging leaf tobacco with the auxiliary equipment necessary for the method.
Figure 5:
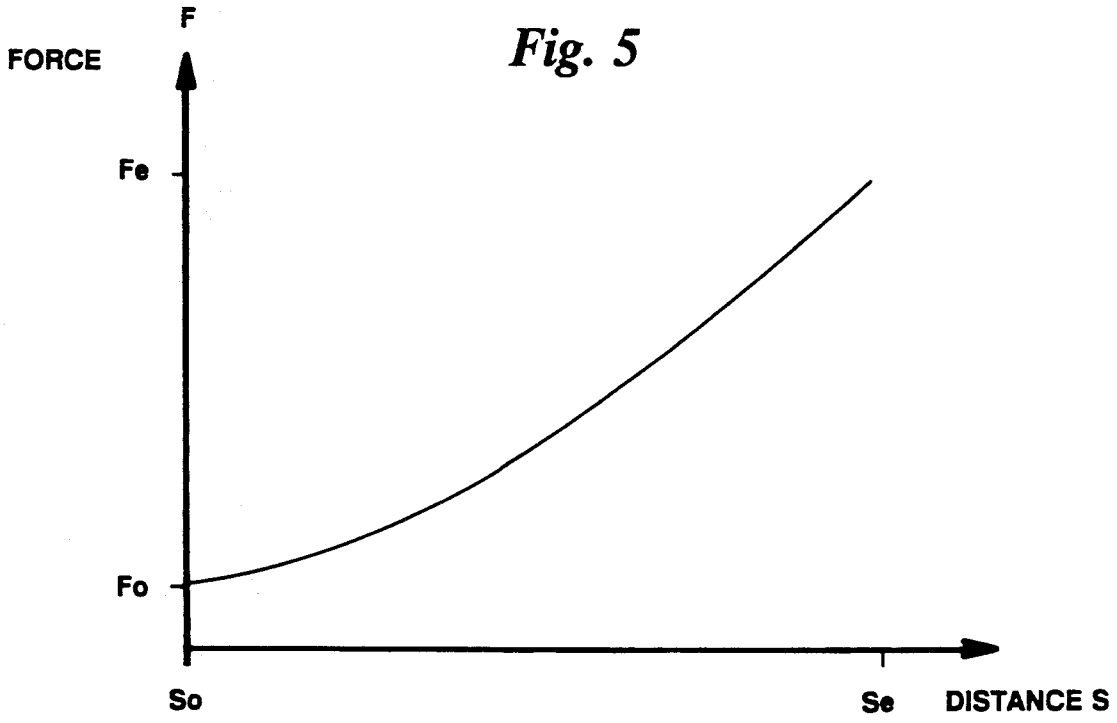
Figure 6:
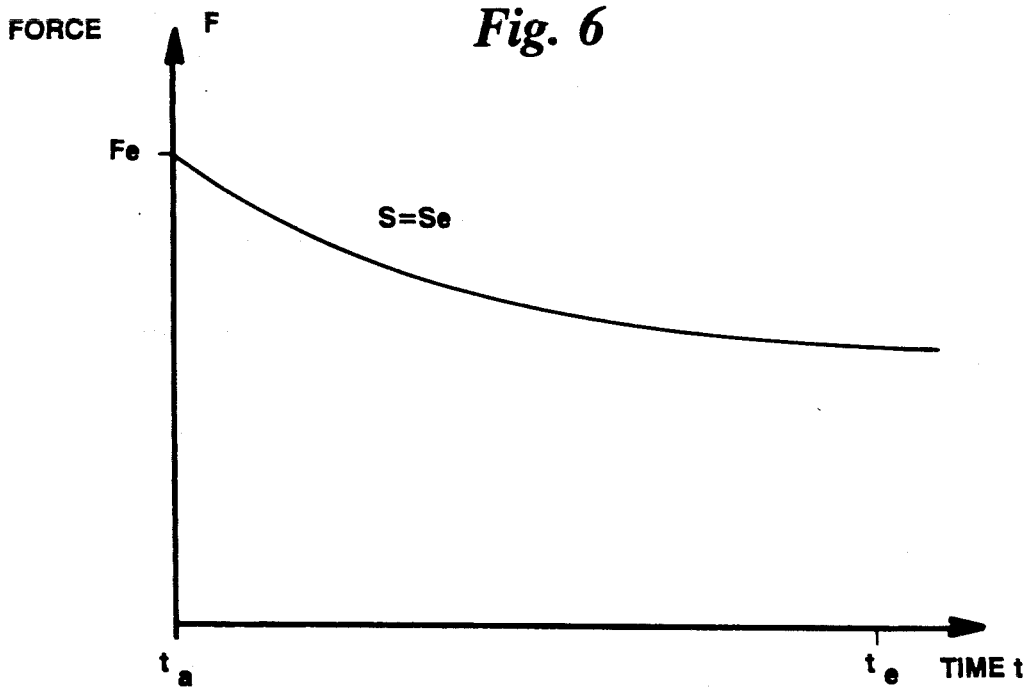

FIGS. 4*a*–4*f* (including *a*–*F*) illustrates various stages in the implementation of the method using the press shown in FIG. 1;

FIG. 5 is a diagrammatic compression curve;

FIG. 6 is a diagrammatic relaxation curve;

FIGS. 7*a*, 7*b* are representations of concurrent stages to illustrate the method; and FIG. 7*c* are explanations of the abbreviations used in FIGS. 7*a* and 7*b*.

DETAILED DESCRIPTION OF THE DRAWING FIGURES

Reference will now be made in detail to a present preferred embodiment of the invention, an example of which is illustrated in the accompanying drawings.

FIG. 1 shows a diagrammatic view of a press used for packaging leaf tobacco R and its auxiliary equipment. This device and the method implemented therewith could be used equally well for packaging and determining the filling capacity of cut tobacco. The embodiment example, however, describes the application of the apparatus and the method to leaf tobacco.

A plunger 2 of the press is moved vertically in the area of a frame 4. The plunger 2 is driven via a driving shaft 6 by a hydraulic drive. This drive and the bearing elements for the driving shaft 6 are situated above the frame 4 and are not shown.

Figure 2:
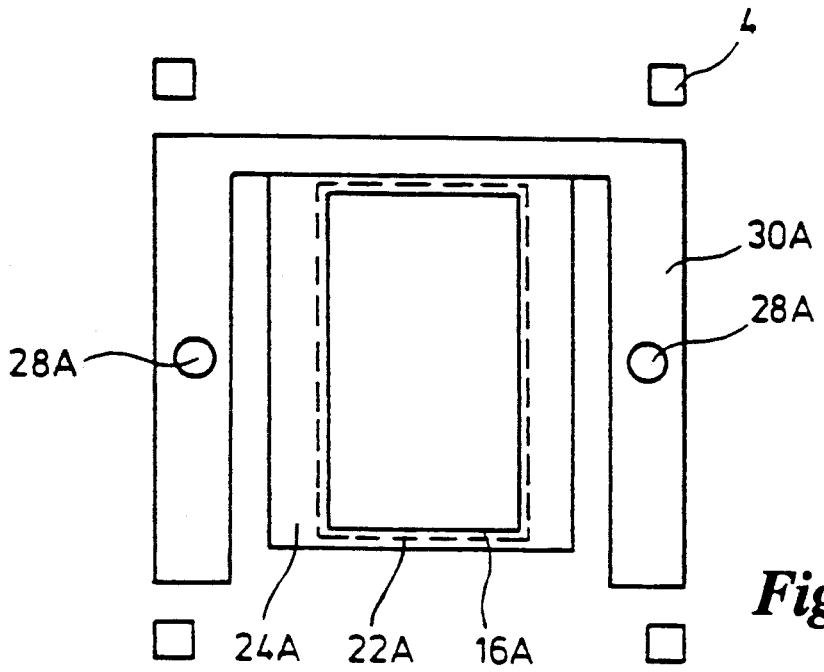
FIG. 2 is a diagrammatic cross-section through the device from FIG. 1 along the section line I—I from FIG. 1.

A first side-arm 8 and a second side-arm 10 are mounted on the upper end of the frame 4. The second side-arm 10 carries a second filling funnel 12 on the right-hand side of the frame 4. A corresponding filling funnel mounted on the first side-arm 8 is not shown. The leaf tobacco to be packed is supplied by a conveyor belt 14 above the frame 4 and falls into a second column or hopper 16B which is widened in the shape of a funnel at its upper end 18B. A first column or hopper 16A, constructed in exactly the same way as the second hopper 16B, is situated, in the phase of the operation shown in FIG. 1, in the region of the frame 4, and the space under the first side-arm 8 is empty. Reference numerals which end with the letter A refer to the first hopper 16A and reference numerals ending with the letter B refer to the second hopper 16B. The hopper 16B stands with its open lower end 20B on a support surface, preferably a packaging container, here a cardboard box 22B. The hopper 16B has a rectangular cross section. Its inner wall surfaces are of essentially smooth construction, as is its external surface in the region of the cardboard box 22B. The cross-section of the hopper 16B is slightly smaller than that of the cardboard box 22B. The hopper 16B together with the cardboard box 22B stands on a movable cardboard box trolley 24B. A cross-support 26B mounted above the cardboard box 22B connects the hopper 16B to two rods 28B, which are mounted on a movable hopper trolley 30B and support the hopper 16B. The cardboard box trolley 24B and the hopper trolley 30B can be moved with each other; moreover, as can be seen from FIG. 2, the cardboard box trolley 24B can be moved with respect to the hopper trolley 30B vertically to the connecting line of the two rods 28B. FIG. 2 shows a cross section through the parts of the device in the region of the frame 4, but the parts which are marked with reference numerals ending in A and B are identical. Above the cardboard box 22B, a pre-compressing device not shown in FIG. 1 can be attached to the hopper 16B, by means of which the tobacco poured into the hopper 16B can be pre-compressed so that a larger overall quantity of tobacco can be filled in.

Before the phase of the operation shown in FIG. 1, leaf tobacco R had already been poured into the first hopper 16A by means of a first filling funnel on the left-hand side of the frame 4, corresponding to the second filling funnel 12. The cross-section of the plunger 2 is rectangular and slightly smaller than the cross-section of the hopper 16A. In the phase of the operation shown in FIG. 1, the leaf tobacco from the first hopper 16A has already been largely compressed into the cardboard box 22A.

Two cross-supports 32 mounted on the frame 4 hold a longitudinal support 34, on which a lifting device 35, not shown in full in FIG. 1, is guided. The lifting device 35 consists in total of two parts, the one indicated and a corresponding one which is situated on the rear side of the frame 4. Both parts of the lifting device 35 have projections which engage beneath corresponding projections, not shown, on the outside of the hopper 16A. The lifting device 35 allows the hopper 16A to be lifted far enough in the vertical direction for its lower end 20A to be situated slightly above the upper edge 23A of the cardboard box 22A.

Underneath the cardboard box trolley 24A an elevating platform 36 is installed which can be moved in the vertical direction by a drive. The wheels of the cardboard box trolley 24A rest on the elevating platform 36. Between the wheels of the cardboard box trolley 24A a fixed support plate 37 is attached to a support-plate substructure 38. The elevating platform 36 with its drive together with the support-plate substructure 38 are seated in an under-frame 40. Before the plunger 2 begins the compression procedure for the leaf tobacco R, the elevating platform 36 is lowered slightly. As a result the cardboard box trolley 24A comes to lie on the fixed support plate 37 and in this way is evenly supported in the region of the cardboard box 22A, and the rollers of the cardboard box trolley 24A are not subjected to the pressing force exerted by the plunger 2. The wheels of the hopper trolley 30A stand outside the area of the elevating platform 36.

As can be seen from FIG. 1, the device shown has several measuring instruments. To establish when enough tobacco has been poured into the second hopper 16B, the hopper 16B including the cardboard box 22B, the cardboard box trolley 24B and the hopper trolley 30B stands on a filling balance 50B. A corresponding filling balance is situated on the left-hand side of the frame 4.

On the upper side of the plunger 2 a commercially available optical length-measurement device is installed which makes possible a precise determination of the position of the plunger 2 and therefore of the height of the compressed tobacco column. This length-measurement device includes a measuring rod 52, which is firmly mounted on the upper side of the plunger 2 and extends parallel to the driving rod 6, and a reading device 54. The reading device 54 scans by optical means markings made on the measuring rod 52 and counts these markings as a measure of the distance covered by the plunger 2. Other embodiments of a device for measuring the height of the compressed tobacco are also possible, e.g., ultrasound length-measurement systems or electrical systems which contain, for example, a potentiometer which is displaced in a defined manner when the plunger 2 moves.

Figure 3:
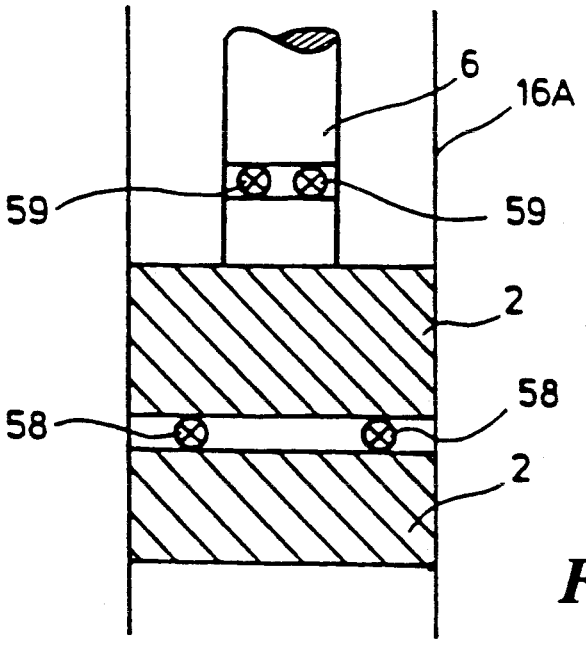
FIG. 3 is a diagrammatic longitudinal section through an alternative design for the plunger of the press from FIG. 1.

In the embodiment, the force which is transmitted to the tobacco R when compressed by the plunger 2 is measured by force-measurement cells 56 which are fitted under the support plate 37 in the support-plate substructure 38. The force-measurement cells 56, four for example, are distributed evenly over the cross-section of the support-plate substructure 38, so that the total transmitted force is registered by the force-measurement cells 56 and is diverted onto the under-frame 40. Force-measurement cells 58 analogous to the force-measurement cells 56 can also be mounted in the plunger 2, see FIG. 3. It is also possible to install force-measurement cells 59 in the driving rod 6. In FIG. 3, both the force-measurement cells 58 and the force-measurement cells 59 are shown; in practice, it is however sufficient for either the force-measurement cells 58 or the force-measurement cells 59 to be present. The pressure in the hydraulic system for driving the plunger 2, which is measured by means of a manometer 57, provides another possibility for determining the force acting on the tobacco R during the compression. In this case the measured pressure must be multiplied by the known cross-sectional area of the hydraulic piston used for driving so as to convert it into a force. The forces determined by these different measuring devices are not, however, the same. For example, the force-measurement cells 56 show, in addition to the force acting on the tobacco R, the weight of the tobacco R, the empty weight of the cardboard box 22A and the weight of the cardboard box trolley 24A; the hopper 16A does not bear on the support plate 37 after the lowering of the elevating platform 36 because the projections on the outside of the hopper 16A are already gripped by the projections of the lifting device 35 when the elevating platform 36 is lowered. In addition, frictional forces along the path of the plunger 2 can lead to differences in the measurement values for the force. It is therefore advantageous to use several force-measurement devices at the same time, e.g., the force-measurement cells 56 and the manometer 57.

In the embodiment shown, the temperature and the moisture of the tobacco R are measured immediately before it is poured into the hopper 16B, by a temperature-measurement device 60 and a moisture measurement device 62, which are both mounted above the conveyor belt 14. The temperature of the tobacco can, for example, be determined with a known infrared measurement device, which detects the heat radiation emitted by the tobacco. Further possible temperature-measurement devices are resistance thermometers or thermoelements. The tobacco moisture can be determined by means of a commercially available infra-red measurement device, which measures the spectral intensity characteristic of water in the infra-red range, but also by means of an electrical conductivity determination. Commercially available devices which make use of a combination of a capacitance and conductivity measurement for determining the tobacco moisture can also be used. In all cases the results obtained for the tobacco moisture are not absolute values, and the moisture-measurement device 62 must be calibrated by reference measurements, e.g., using a drying chamber. In alternative versions it is also conceivable to determine the temperature and/or moisture of the tobacco during the phases of operation in the press or thereafter.

The reading device 54 of the length-measurement system, the force-measurement cells 56, 58, 59, the manometer 57, the temperature-measurement device 60 and the moisture measurement device 62 are equipped with electronic transducers and interfaces, to transmit the acquired data to a computer not shown in FIG. 1. In an advantageous manner instead of one computer, several computers networked together can be used. Also not shown in FIG. 1 is a balance on which in the embodiment the cardboard box 22 with the filled-in tobacco R is weighed after the packaging process. This balance has a greater accuracy than the filling balance 50, which is important for the establishment of the filling capacity, because the mass of the compressed tobacco passes directly into the filling capacity. There are also other possibilities for the precise weighing of the filled-in leaf tobacco, e.g., a belt-weighing device installed on the conveyor belt 14. Also this balance, which is not shown, is connected to the computer via an electronic transducer and an interface.

The computer assumes total control of the process for the determination of the filling capacity of tobacco. It receives signals, for example, from the filling balance 50B or a hopper sensor 64 which detects when the hopper 16A is standing in its correct position under the frame 4, and issues control commands to the respective components of the system for acquisition of the measurement data. The press is controlled via relays and operates independently. At certain times in its operating cycle, however, it sends signals to the computer for synchronization with the rest of the procedure. Those activities of the computer which are not essential for the process of determining the filling capacity of leaf tobacco are not shown in detail.

The individual stages of the process are described in the following by means of FIG. 4, as implemented by the apparatus explained above. FIGS. *7a* and *7b* show the chronological sequence of the stages which run in parallel. The first three columns of FIG. *7a* show the phases of operation of the press, i.e., column 201 shows the operations taking place in the first hopper 16A, column 202 those taking place at the same time in the second hopper 16B and column 203 shows the movement of the plunger 2. Column 204 shows the measurements of the temperature T and of the water content (moisture) WG of the tobacco as a function of time t. The index j represents the serial number of the measurement cycle, i.e., the serial number of the cardboard box 22 which is being filled at that time with leaf tobacco. Column 205 describes the sequence of the measurements carried out on the press for the force F which acts on the tobacco, for the pressure P to drive the plunger 2 and for the distance S covered by the plunger 2 as a function of time t, and also the determination of the tobacco mass m. Column 206 indicates characteristic signals 101 to 109 which are transmitted from the press including its auxiliary equipment to the computer. In the embodiment the computer system comprises two computers networked together, namely a process-control computer, which performs the functions illustrated in FIG. *7b*, column 207, and a main computer which performs the tasks listed in column 208. The signals 101 to 109 and the abbreviations used in FIGS. *7a* and *7b* are explained in FIG. *7c*.

At the beginning of the operation or process, master data are entered into the main computer, such as, for example, details of the type of tobacco to be packed, the cycle number, i.e., the number of cardboard boxes to be filled with tobacco, and values for control parameters for the process-control computer, such as the initial value S of the distance measurement or the scanning rate for the distance measurement, i.e., the number of length measurements to be carried out per unit of time. The relevant master data for the process-control computer are transmitted to the process control computer. The chronological description begins with the filling of the first hopper 16A, which is situated left of the frame 4 under the filling funnel carried by the first side-arm 8. When the first hopper 16A has reached its nominal weight, the corresponding filling balance 50A sends a signal 101 to the process-control computer. The first hopper 16A is then moved together with the cardboard box 22A, the cardboard box trolley 24A and the hopper trolley 30A into the area of the frame 4, and the elevating platform 36 is lowered slightly so that the cardboard box trolley 24A lies on the support plate 37.

At the same time the direction of the conveyor belt 14 is reversed so that the next tobacco is poured into the second hopper 16B via the second filling funnel 12.

If the hopper 16A is standing in the correct position after being moved, the hopper sensor 64 sends a signal 102 to the main computer via the process-control computer. Thereupon when the plunger 2 is at rest, the process-control computer acquires the initial data associated with cardboard box No. j, $Fo_j$ for the force and $Po_j$ for the pressure of the hydraulic fluid. After a defined delay time, beginning with the signal 102, the press-control system initiates a downward movement of the plunger 2, and when this begins it sends a signal 103 to the process-control computer. The leaf tobacco R in the hopper 16A is compressed as soon as it is touched by the plunger 2; in the starting phase, however, the force exerted on the tobacco is small and difficult to reproduce. Thus the plunger 2 is initially moved without the acquisition of the associated measurement variables. When a predetermined position So, the initial value of the distance measurement, is reached, the reading device 54 of the length-measurement system transmits a signal 104 to the process-control computer, see also FIG. 4(*a*). As the plunger 2 travels further downwards, the process-control computer continuously receives measurement values $F_j(t)$, $P_j(t)$ and $S_j(t)$ for the force exerted on the tobacco R, the pressure of the hydraulic fluid and the distance covered by the plunger 2 as a function of the time t. The corresponding initial values are immediately subtracted from the measurement values and the results are stored in the process-control computer. These data are used to form a compression curve (FIG. 5). FIG. 4(*b*) shows the corresponding operation phase of the press.

As soon as the lower edge of the plunger 2 has reached a lowest position Se as set on the press, see FIG. 4(*c*), which lies below the upper edge 23A of the cardboard box 22A, the press-control system switches off the drive hydraulics for the plunger 2, and a signal 105 is transmitted to the process-control computer. The plunger 2 remains for a certain length of time in its lowest position Se. During this relaxation time the measurement values $F_j(t)$ and $P_j(t)$ are transmitted continuously to the process-control computer, the initial values are subtracted and the results are stored. At the beginning of the relaxation phase the press-control system issues a signal 106 to the process-control computer and initiates a lifting of the first hopper 16A by means of the lifting device 35. As soon as the lower end 20A of the hopper 16A is above the upper edge 23A of the cardboard box 22A, as shown in FIG. 4(*d*), i.e., as soon as the hopper 16A has reached its top position, a signal 107 is transmitted to the process-control computer. The measurement values $F_j(t)$ and $P_j(t)$ acquired between the signals 106 and 107 are marked because they are affected by the movement of the hopper 16A. After the predetermined relaxation time has elapsed the press-control system effects an upward movement of the plunger 2 and sends a signal 108 to the process-control computer.

The cardboard box 22A is moved away on its cardboard box trolley 24A from the region of the frame 4, see FIG. 4(*e*), and transported to the balance not shown in FIG. 1. As soon as it has reached the balance, a signal 109 is transmitted to the process-control computer, the tobacco cardboard box is weighed and the measured value $m_j$ for the tobacco mass is transmitted to the process-control computer. In the meantime a new cardboard box 22A, No. j+2, on a cardboard box trolley 24A is moved under the raised first hopper 16A, and the hopper 16A is lowered. It is then moved back under the filling funnel of the first side-arm 8. The process-control computer transmits to the main computer the measured values for the cardboard box j, corrected to take account of the initial values.

In the meantime, the second hopper 16B has been filled with leaf 5 tobacco R via the second filling funnel 12, as also shown in FIG. 1. During the filling process, the temperature $T_{j+}(t)$ of the tobacco destined for cardboard box 22B No. j+1, and its water content $WG_{j+1}(t)$ in relation to time t have been continuously recorded by the temperature-measurement device 60 and the moisture measurement device 62, transmitted to the main computer and submitted to an averaging process. At the same time, the main computer continuously asks the process-control computer whether there are any data to be transmitted. As soon as this is the case, the main computer receives the measured values for the cardboard box No. j from the process-control computer. Shortly thereafter the filling process for the second hopper 16B is also completed and the final averages for the temperature T and moisture WG of the leaf tobacco for the cardboard box No. j+1 are available. The phases and stages of the operation and the acquisition of the appropriate measured values are then repeated exactly as described above, only this time the leaf tobacco is compressed in the second hopper 16B and the first hopper 16A is filled. FIG. 4(*f*) shows the moment when the plunger 2 has reached the initial value So of the distance measurement in the second hopper 16B.

From the received measured values, the main computer calculates a compression curve and a relaxation curve for the tobacco in cardboard box No. j. The tobacco mass $m_j$ is used for standardization. The averages for the temperature T and the water content WG of the tobacco are used for an immediate or subsequent adjustment of the obtained filling capacity data to standard conditions, e.g., 12% water content and 22° C. This allows a physical evaluation of the leaf tobacco filled into the cardboard box No. j and a subsequent correlation with values for the filling capacity of the cut tobacco produced from this leaf tobacco.

A typical compression curve is shown in FIG. 5. The measured values obtained during the downward movement of the plunger 2 for the force F acting on the tobacco and the distance S covered by the plunger 2, which can be converted with the aid of So into the length of the tobacco column, are plotted against each other. While the distance changes from its initial value So to its end value Se, the force increases from an initial value Fo to an end value Fe. Note that the shape of the curve is also dependent on the speed with which the plunger 2 is moved, because a relaxation effect already takes place during the compression of the tobacco.

In FIG. 6 a typical relaxation curve is shown. While the plunger 2 remains in its lowest position Se, the force Fe occurring at the starting time ta drops as time passes. At time te the measurement is ended.

In this embodiment a method for determining the filling capacity of tobacco has been described which uses as the apparatus a press by means of which tobacco is filled into a packaging container from a moving belt and compressed. Alternatively, the filling capacity of tobacco can also be determined by means of a press which carries out additional pressing of the tobacco. In this case, tobacco can be filled into a cardboard box or packaging container in a similar way to that described, but without obtaining measured values for the length of the tobacco column and the force acting on the tobacco. The tobacco is greatly compressed here. If a fairly long time span elapses between the removal of the cardboard box from the area of the filling press and the closing of the lid, the volume of the tobacco in the cardboard box can increase to such an extent that additional pressing is necessary before closing the lid. For additional pressing a further press is used which is fitted with measurement systems for determining the distance covered by its plunger and the force acting on the tobacco. These measurement systems and others for recording the tobacco temperature and moisture are connected to a computer. From the measured values acquired during the additional pressing process for the distance covered by the plunger or the respective length of the tobacco column and the force acting on the tobacco, a compression curve can be plotted as before. A relaxation curve can also be obtained in an analogous manner. The curves obtained look qualitatively similar to those shown in FIG. 5 and FIG. 6. Since the tobacco has already been compressed before the additional pressing, the range of the change in distance is, however, less than in the first embodiment described. Only data which have been acquired using the same measurement process can be compared with each other.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for determining the filling capacity of tobacco wherein a predetermined quantity of tobacco is filled into a volume of known cross-section defined by a column, closed on one side by a movable plunger forming part of a tobacco press and on its other side by a support surface, comprising the steps of:

disposing the tobacco into the column onto the support surface;

compressing the tobacco in the volume by relatively moving the plunger and support surface toward one another;

determining the length of the tobacco column during relative movement of the plunger and support surface as a function of time by measuring the distance covered by the relative movement of the plunger and the support surface and providing an output signal responsive thereto;

determining the force acting on the tobacco as a function of time when the tobacco is compressed in the column and providing an output signal responsive thereto;

independently measuring at least one of temperature and moisture content of the tobacco and providing an output signal in response thereto; and processing said signals by a computer to determine the filling capacity of the tobacco.

2. A method according to claim 1 wherein the step of compressing the tobacco is accomplished by moving the plunger toward the support surface, and the step of determining the force acting on the tobacco is determined by measuring the pressure required to drive the plunger.

3. A method according to claim 1 wherein the step of compressing the tobacco is accomplished by moving the plunger toward the support surface, and the step of determining the force acting on the tobacco is determined by measuring the supporting force required to hold the support surface.

4. A method according to claim 1 wherein the step of compressing the tobacco is accomplished by moving the plunger toward the support surface, and the step of determining the force acting on the tobacco is determined by measuring the force occurring at the plunger.

5. A method according to claim 1 wherein the plunger has a drive element and wherein the step of determining the force acting on the tobacco is determined by measuring the force on the drive element.

6. A method according to claim 1 including the step of measuring both of temperature and moisture content and providing output signals responsive thereto.

7. A method according to claim 1, wherein the steps are applied to leaf tobacco.

8. A method according to claim 1 including recording a compression curve wherein the force acting on the tobacco during the compression is shown as a function of the length of the tobacco column, and in which curve the plunger speed is used as a parameter.

9. A method according to claim 1 including recording a relaxation curve wherein the force acting on the tobacco is shown as a function of time, after the plunger has reached its end position and the compressed tobacco column has reached its minimum length and while the plunger remains in its end position.

10. A method according to claim 1 including employing at least a single measurement point during the compression of the tobacco for the force acting on the tobacco and the associated length of the tobacco column.

11. A method according to claim 1 including employing no more than a few measurement points for the force acting on the tobacco as a function of time, after the plunger has reached its end position and the compressed tobacco column has reached its minimum length and while the plunger remains in its end position.

12. A method according to claim 1 including the step of weighing the mass of the filled-in tobacco and providing a signal in response thereto.

13. A method according to claim 1 wherein the support surface comprises a packaging container into which the column is received before the tobacco is disposed into the column, and including the step of removing the column from the container subsequent to compressing the tobacco in the container.

14. Apparatus for determining the filling capacity of tobacco comprising:

a press for compressing a predetermined quantity of tobacco including a column for receiving the tobacco and a movable plunger for movement within the column;

a packaging container for receiving the lower end of the column and the quantity of tobacco in the column when compressed by said plunger;

a distance measurement device for measuring the distance moved by said plunger when compressing the tobacco;

a measurement device for determining the force acting on the tobacco during compression thereof and providing an output signal in response thereto;

means for measuring at least one of the temperature and moisture content of the tobacco and providing an output signal in response thereto; and at least one computer for processing said signals for determining the filling capacity.

15. Apparatus according to claim 14 including means for measuring both the temperature and moisture content of the tobacco and providing output signals in response thereto.

16. Apparatus according to claim 14 wherein said force measuring means includes means for measuring the pressure required to drive said plunger.

* * * * *